US006895597B1

(12) United States Patent
Rakic

(10) Patent No.: US 6,895,597 B1
(45) Date of Patent: May 24, 2005

(54) SELF-ADJUSTING GARMENT

(76) Inventor: Tomislav Rakic, 7231 Langerford Dr., Parma, OH (US) 44129

( * ) Notice: Subject to any disclaimer, the term of this patent is extended or adjusted under 35 U.S.C. 154(b) by 76 days.

(21) Appl. No.: 10/248,523

(22) Filed: Jan. 27, 2003

Related U.S. Application Data

(60) Provisional application No. 60/319,143, filed on Mar. 13, 2002.

(51) Int. Cl.[7] ..... A41D 27/10

(52) U.S. Cl. ..... 2/93; 2/115; 2/243.1

(58) Field of Search ..... 2/74, 75, 77, 80, 2/83, 94, 121, 122, 243.1, 275, 69, 247, 84, 114, 93, 97, 108, 115, 272, 106, 85, 125

(56) References Cited

U.S. PATENT DOCUMENTS 1,121,581 A * 12/1914 Cohn et al. ..... 2/93
1,177,952 A * 4/1916 Inman ..... 2/93
1,777,664 A 10/1930 Garey
1,830,147 A 11/1931 Walshe
1,854,476 A 4/1932 Mason
1,936,493 A 11/1933 Baar
1,949,312 A 2/1934 Konski
1,973,419 A * 9/1934 Trageser ..... 2/93
2,106,412 A * 1/1938 Oviatt ..... 2/115
2,159,408 A * 5/1939 Siegel ..... 2/93
2,194,156 A * 3/1940 Speh ..... 2/93
2,323,777 A * 7/1943 Katz ..... 2/93
2,457,356 A * 12/1948 Enck ..... 2/93
2,514,276 A * 7/1950 Berman ..... 2/93
2,694,202 A * 11/1954 Macrides ..... 2/115
3,049,719 A * 8/1962 Hyman ..... 2/93
3,153,793 A * 10/1964 Lepore ..... 2/93
3,654,632 A * 4/1972 Lacroix ..... 2/125
4,608,715 A * 9/1986 Miller et al. ..... 2/1
5,218,720 A * 6/1993 Tolton ..... 2/97
5,383,235 A 1/1995 Peters
6,052,826 A * 4/2000 Tolton ..... 2/87
6,079,343 A 6/2000 Wong
6,253,379 B1 * 7/2001 Collier ..... 2/108

* cited by examiner

*Primary Examiner*—Gary L Welch
*Assistant Examiner*—Alissa L. Hoey
(74) *Attorney, Agent, or Firm*—Christopher L. Parmelee; Walker & Jocke LPA

(57) ABSTRACT

A self-adjusting garment is provided. The garment comprises a back upper body portion that is adapted to cover at least a portion of a back upper body of a person. The back upper body portion includes at least one pleat therein. The garment further comprises at least one sleeve portion in operative connection with the back upper body portion. The sleeve portion is adapted to receive an arm of the person therethrough. The pleat is positioned adjacent a seam between the back upper body portion and the sleeve portion. The pleat includes an inner fold and an outer fold which forms an overlapped region. The pleat is adapted to gather excess material in the back upper body portion so as to enable the back upper body portion to lie in generally flat orientation adjacent the back upper body of the person.

33 Claims, 7 Drawing Sheets

SELF-ADJUSTING GARMENT

CROSS REFERENCE TO RELATED APPLICATIONS

This application claims benefit of U.S. Provisional Application Ser. No. 60/319,143 filed Mar. 13, 2002.

TECHNICAL FIELD

This invention relates to self adjusting garments. Specifically, this invention relates to suit jackets or other upper body garments that are capable of automatically minimizing the wrinkling of material in the back of the garment for a plurality of differently sized individuals.

BACKGROUND ART

Suit jackets, coats, shirts, and other types of upper body garments are well known. Such garments are often manufactured in a plurality of different sizes to accommodate the various sizes of individuals. For example, suit jackets often are categorized by a numbering system in which large suits are associated with larger numbers. For example, an average sized man may wear a jacket size that is numbered between 40–46, whereas a larger man may require a jacket size that is numbered 50 or higher. In each case, a properly sized suit jacket will have sufficient size in the shoulders, arm length and waist to enable the person to be comfortable in a plurality of different positions. However, a properly sized suit jacket must also not include too much excess material which may bunch up or wrinkle when the person is in a relaxed position with his arms down at his sides.

Unfortunately, the relatively small number of standard sizes of suit jackets generally does not accommodate the large variation in human torsos. As a result, suit jackets must often be tailored to change the sleeve length, button location, and seam positions. Individuals that desire a suit jacket that fits exceptionally well, will often have the back panel portions of the suit jacket altered to remove wrinkles and bunched up material that tends to form in the back of the jacket in standard sized suit jackets. FIG. 1, shows an example of a prior art standard sized suit jacket 10 prior to being altered to fit the owner of the jacket. When worn, such pre-altered jackets often include vertical wrinkles or bunched up material 18 adjacent the seam 12 between the arm sleeves 14 and the back panel 16 of the jacket 10.

Although tailoring can produce a suit jacket or other upper body garment that fits a person properly, such tailoring adds additional expense and is inconvenient to the purchaser of the jacket. Also, if the person gains or loses weight, the suit jacket must again be altered to fit properly. Thus, there exists a need for a suit jacket or other upper body garment that can be manufactured in a form that can accommodate a larger variation in human torsos without alteration. There further exists a need for a suit jacket or other upper body garment that can be manufactured in a form that minimizes the wrinkling of material in the upper back portions of the garment for a plurality of differently sized torsos.

As discussed previously, manufacturers of garments such as suit jackets generally produce different styles or models of jackets in a plurality of different sizes which are numbered from small to large. Generally, a size 40 suit jacket from one manufacturer is similar in fit to a size 40 suit jacket from another manufacturer. When suits are sold, suits are grouped according to jacket size. Thus, many retailers will group suits with size 40 jackets together from a plurality of different manufacturers.

When a customer is looking for a new suit, the salesperson often has the customer try on a sample jacket to determine what jacket size is most appropriate for the customer. The customer is then instructed to browse suits from the grouping of suits with the same jacket size. Unfortunately, even though the jacket size may fit fairly well, the other characteristics of the suit may not fit the customer well. For example, manufacturers often associate suit pants with about a 33 inch waist size with suit jackets of size 40. If the customer has a thinner or wider waist, the suit paints will need to be altered to properly fit the customer.

Pant legs are typically left unhemmed on the display racks and only require the material to be cut and sewed. Altering the waistline, however, requires additional work that includes removing the current stitching and restitching the material according to the measured waist size of the customer. As a result, more alterations to the total suit are typically necessary for those individuals that do not exactly match the standards associated with a standard suit jacket size. Consequently, there exists a need for a new system of fitting individuals to a new suit which minimizes the amount of alterations required to properly fit the suit to the customer.

DISCLOSURE OF INVENTION

It is an object of an exemplary form of the present invention to provide an upper body garment.

It is a further object of an exemplary form of the present invention to provide an upper body garment which accommodates larger variations in human torsos without alteration.

It is a further object of an exemplary form of the present invention to provide an upper body garment which minimizes the wrinkling of material in the upper back portions of the garment for a plurality of differently sized torsos.

It is a further object of an exemplary form of the present invention to provide a method of producing an upper body garment which accommodates larger variations in human torsos without alteration.

It is a further object of an exemplary form of the present invention to provide a method of producing an upper body garment which minimizes the wrinkling of material in the upper back portions of the garment for a plurality of differently sized torsos.

It is a further object of an exemplary form of the present invention to provide an upper body garment that can be manufactured in a form which accommodates larger variations in human torsos without alteration.

It is a further object of an exemplary form of the present invention to provide an upper body garment which can be manufactured in a form that minimizes the wrinkling of material in the upper back portions of the garment for a plurality of differently sized torsos.

It is a further object of an exemplary form of the present invention to provide a new method of manufacturing suits which minimizes the amount of alterations required to properly fit the suits to customers.

It is a further object of an exemplary form of the present invention to provide a new method of fitting individuals to a suit which minimizes the amount of alterations required to properly fit the suit to the customer.

Further objects of exemplary forms of the present invention will be made apparent in the following Best Modes for Carrying Out Invention and the appended claims.

The foregoing objects are accomplished in an exemplary embodiment by a new design or cut for a suit jacket or any other type of an upper body garment. For purposes of this disclosure, a suit jacket will be described in many of the examples of the embodiments of the invention. However, it is to be understood that the invention encompasses other types of upper body garments such as shirts, coats, dresses, or any other type of clothing that spans the upper back and shoulder regions of a person.

In the exemplary embodiment, the suit jacket includes pleats adjacent the seams between each arm sleeve and the back panel of the suit jacket. The pleats are constructed so as to gather excess material from the back panel. As a result, the back panel portions of the suit jacket will lie in a generally smooth manner adjacent the back of the individual. The pleats are operative to minimize the formation of wrinkles or bunches of excess material in the back panel when the arms of the individual are down at the person's sides.

In addition, the pleats are constructed so as to release excess material from the pleat as the person stretches his arms upwardly or forward. The pleats enable the back panel to be extensible which provides more comfort to the person when moving between different arm and torso positions.

The construction of the pleats also enables the jacket to be comfortably worn by individuals with different torso sizes and configurations. Thus, an exemplary embodiment of the suit jacket may be comfortably worn by both a man that typically wears a standard size 40 suit jacket and another man that typically wears a standard size 44 jacket. For the smaller individual, the pleats are operative to gather excess suit jacket material from the back panel so as to minimize the formation of vertical wrinkles in the back panel. For the larger individual, the pleats enable the back panel to automatically widen so that the jacket will fit more comfortably on the torso of the larger individual.

In an exemplary embodiment, the pleats in the suit jacket may not include manufactured, ironed, or pressed creases in the folded portions of the pleats. Rather, the folds may be generally rounded. As a result, the location of portions of the folded portions of the back panel may change or shift responsive to the size of the person wearing the jacket and the position of the torso of the person.

Because the exemplary embodiments of the jackets may accommodate differently sized torsos, a person may be fitted to anew suit differently. For example, in an exemplary embodiment, suits may be manufactured with labels which designate the waist size of the suit. For example, if the suit has pants and a suit jacket designed to fit a person with a 33 inch waist, the suit may include a label which indicates a 33 inch waist.

When selecting suits of the exemplary embodiment, the person may first select those suits which correspond to the person's waist size. Thus, if the person has a 35 inch waist size, the person may select suits to try on which are labeled with a 35 inch waist size. The exemplary jackets of the suits which come with the pants may be configured with button positions which are appropriate for a man with a 35 inch waist. In addition, the suit jackets which are labeled with a 35 inch waist may further include the previously described pleats which are operative to enable the suit jacket to properly fit individuals of a plurality of different upper body sizes. Thus, the suit jacket with 35 inch waist pants may be operative to adequately fit both a man who typically wears a standard 42 jacket and a man who typically wears a standard 44 jacket.

In further exemplary embodiments, the suit jackets with the previously described pleats may be labeled with a number range that corresponds to the range of standard suit jacket sizes with which the jacket corresponds. For example, the previously described suit with the 35 inch waist pants may include a suit jacket with the exemplary pleats that is labeled with a range such as "42–44".

A retailer, or other sales outlet for suits, may group suits according to waist size rather than, or in addition to, grouping suits by jacket size. Thus, suits with 33 inch waists may be grouped together on racks. A person with a waist size of 33 may then browse the selection of 33 inch waist size suits. Each of the jackets may include the previously described pleats and thus are operative to accommodate a large percentage of the various torsos of individuals with 33 inch waists. For individuals who fall within the range of sizes that are accommodated by the exemplary suit jackets, the alterations required for the suit may be limited to hemming the pant legs.

BEST MODES FOR CARRYING OUT INVENTION

Figure 1:
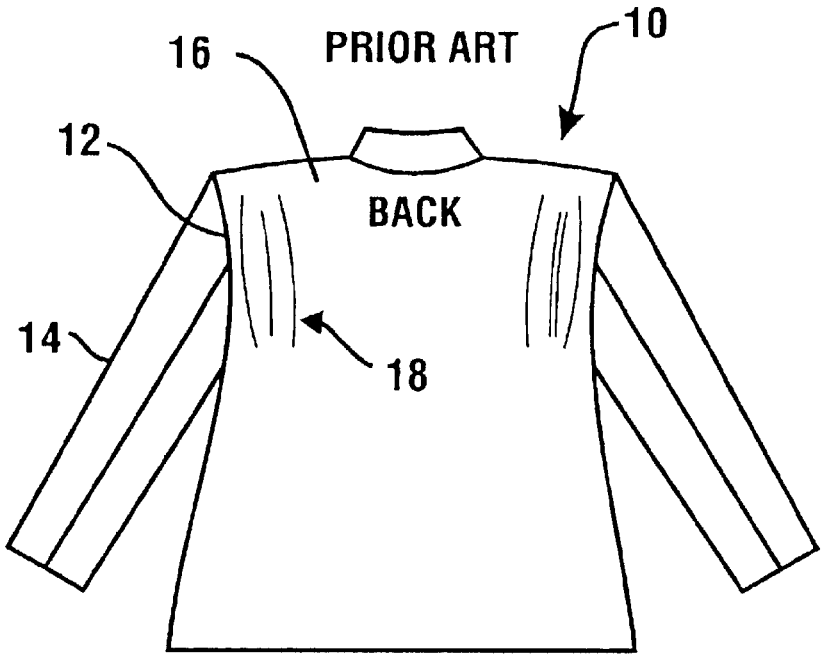
FIG. 1 is a back view of a prior art suit jacket.
Figure 2:
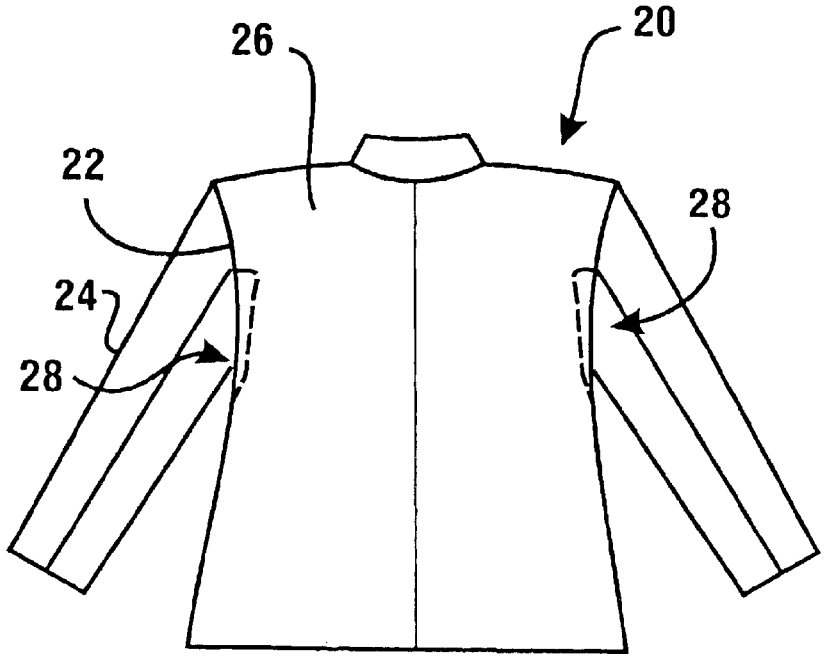
FIG. 2 is a back view of an exemplary embodiment of a suit jacket with pleats adjacent the seam between the back panel and the arm sleeves.

Referring now to the drawings, and particularly to FIG. 2, there is shown therein a perspective view of an exemplary garment 20. As described herein, the exemplary garment corresponds to a suit jacket. However, it is to be understood that in other exemplary embodiments, other garments may be constructed to include the exemplary features of the present invention such as coats, dresses, shirts, or any other garment that is worn on the upper body of an individual.

The exemplary garment 20 includes a back upper body portion, such as a back panel 26 that is adapted to cover at least a portion of a back upper body of a person. The exemplary garment 20 further includes sleeve portions such as an arm sleeve 24 in operative connection with the back panel 26. The arm sleeves of the garment are adapted to receive the arms of a person therethrough. In the exemplary embodiment, the back panel 26 includes pleats 28 therein. The pleats may be positioned adjacent the seams 22 between the back panel 26 and the arm sleeves 24.

In an exemplary embodiment, the pleat includes overlapped material from the back panel which is stitched together at the seam between the back panel 26 and the arm sleeve. The exemplary pleat is operative to gather excess back panel material so that the back panel may lie in a flattening manner adjacent the back upper body of the person. When the garment is worn by an upright person with the person's arms down at his/her sides, the pleats in conjunction with gravity are operative to minimize the formation of vertical wrinkles adjacent the arm sleeve in the back of the garment. In one exemplary embodiment, the overlapped material of the pleat is stitched together with tension between the different layers. The tension in the pleat may be further operative to orientate the material that comprises the pleat and the back panel in a configuration that minimizes the formation of wrinkles in the back panel.

Figure 3:
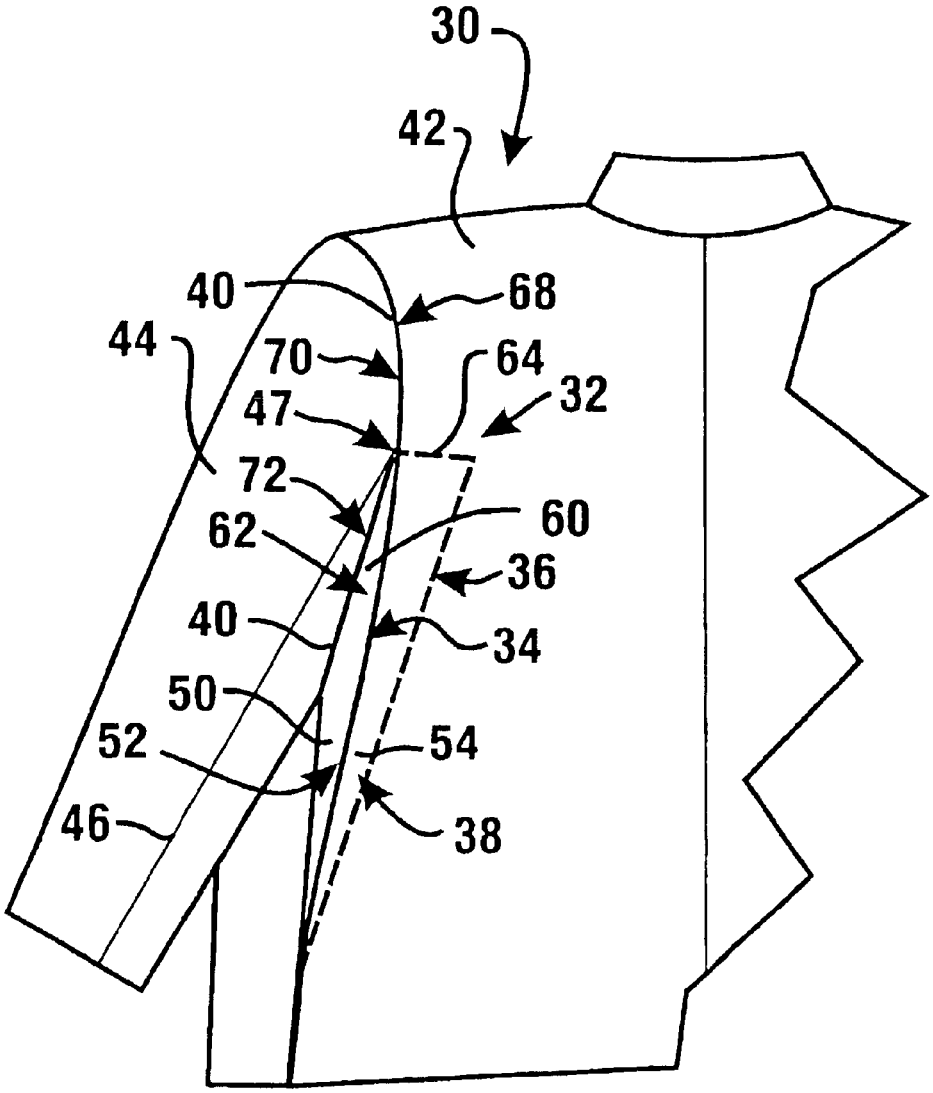
FIG. 3 is a perspective view of an exemplary embodiment of the pleat.

FIG. 3 shows a back perspective view of a suit jacket 30 with an exemplary embodiment of a pleat 32 adjacent a seam 40 between the back panel 42 and the arm sleeve 44 of the jacket. The pleat 32 includes an outer fold 34 and an inner fold 36 which forms an overlapped region 38 with an inner layer of material 50, a middle layer of material 52, and an outer layer of material 54. In an exemplary embodiment, the outer and inner folds 34, 36 do not include pressed-in creases along the length of the folds.

In the exemplary embodiment, the outer and inner folds 34, 36 are operative to form a pocket 60 and an opening 62 to the pocket. The opening 62 to the pocket generally faces in the direction of the arm sleeve 44 of the jacket. The exemplary pleat includes a generally horizontal stitching 64 between the inner layer 50 and the middle layer 52 which bounds the upper portion of the pocket 60. The generally horizontal stitching extends between the inner fold 36 and the upper the seam 40 between the back panel 42 and the arm sleeve 44.

The exemplary embodiment of the jacket 30, further includes a stitching 68 at the seem 40 between the back panel and the arm sleeve. The 68 stitching includes a first portion 70 and a second portion 72. The first portion 70 of the stitching is operative to bind both an upper end of the outer layer 54 and an upper end of the inner layer 50 together and to the arm sleeve 44. The second portion 72 of the stitching is operative to bind a lower end of the inner layer 50 to the arm sleeve 44. The second portion 72 of the stitching does not directly stitch a lower end of the outer layer 54 to the sleeve portion. As a result, the opening 62 to the pocket 60 is formed adjacent the second portion 72 of the stitching.

In the exemplary embodiment, the generally horizontal stitching 64 between the inner layer 50 and the middle layer 52 of the pleat is located adjacent the intersection between the first portion 70 and the second portion 72 of the stitching 68. In an exemplary embodiment, the horizontal stitching is orientated generally perpendicular to the stitching 68 at the seem 40 between the back panel and the arm sleeve.

To provide the previously described tension between layers of the pleat, the stitching 68 at the seam 40 includes the inner layer 50 stitched to the arm sleeve 44 such that the upper end of the inner layer adjacent the first portion 70 of the stitching is bent towards the seam 40 with respect to the lower end of the inner layer adjacent the second portion 70 of the stitching. In the exemplary embodiment, the inner layer is bent at about the location of the generally horizontal stitching 64.

In the exemplary embodiment, when the jacket is being worn by a person, the outer fold 34 is generally vertically aligned with the seam 40 between the back panel 42 and the arm sleeve 44 of the jacket. Also in the exemplary embodiment, the generally horizontal stitching 64 and/or the intersection between the first portion 70 and the second portion 72 of the stitching 68 is positioned in the jacket at about the location of the top or upper termination point 47 of the elbow sleeve seam 46 of the arm sleeve. However, it is to be understood that in other exemplary embodiments, the position of the pleat may be moved upward or downward with respect to the position of the upper termination point 47 of elbow sleeve seam 46 to accommodate different looks, configurations, and performance requirements for different garments.

Figure 4:
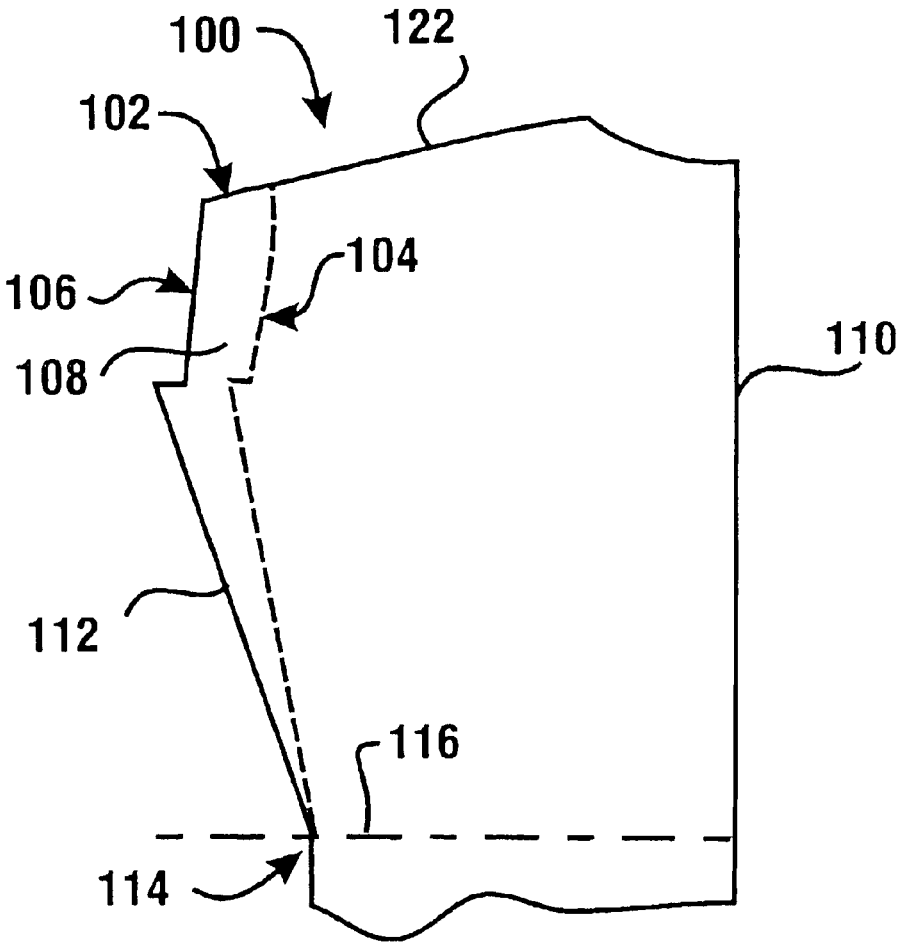
FIG. 4 shows a top plan view of an exemplary cut for a back panel.

FIGS. 4–7 shows an exemplary method for producing the previously described pleat in a garment. FIG. 4 shows an example of an outer contour or cut 102 of material for a back panel 100 of a suit jacket prior to the back panel being sewn as part of a completed jacket. The back panel is cut to include a shoulder seam edge 122, an arm hole seam edge 106, a side seam edge 112 and a center seam edge 110.

The dashed line labeled with reference numeral 104 generally corresponds to the relative position of a standard back panel cut for a standard sized suit. In this described exemplary embodiment to produce a suit with pleats that is operative to fit similarly to a standard sized suit, the arm hole seam edge 106 of the back panel is cut farther away from the center seam edge 110 of the back panel compared to a corresponding standard back panel cut 104. In this described exemplary embodiment, the arm hole seam edge 106 is cut about two inches wider to produce a pleat that is about an inch in width after the back panel is folded to form the pleat. However, it is to be understood that in alternative exemplary embodiments, other widths for the pleat and the position for the arm hole seam edge 106 may be chosen depending on the desired look, configuration, and performance criterial for the garment.

In this described embodiment, the side seam edge 112 of the back panel tapers inwardly from the arm hole seam edge 106 until it has a width with respect to the center seam edge 110 that generally corresponds to the location of a standard cut for a back panel. In the exemplary embodiment, the side seam edge 112 becomes aligned with the standard side seam edge of a standard suit jacket at about a location 114 adjacent the waist line 116 of the jacket.

Figure 5:
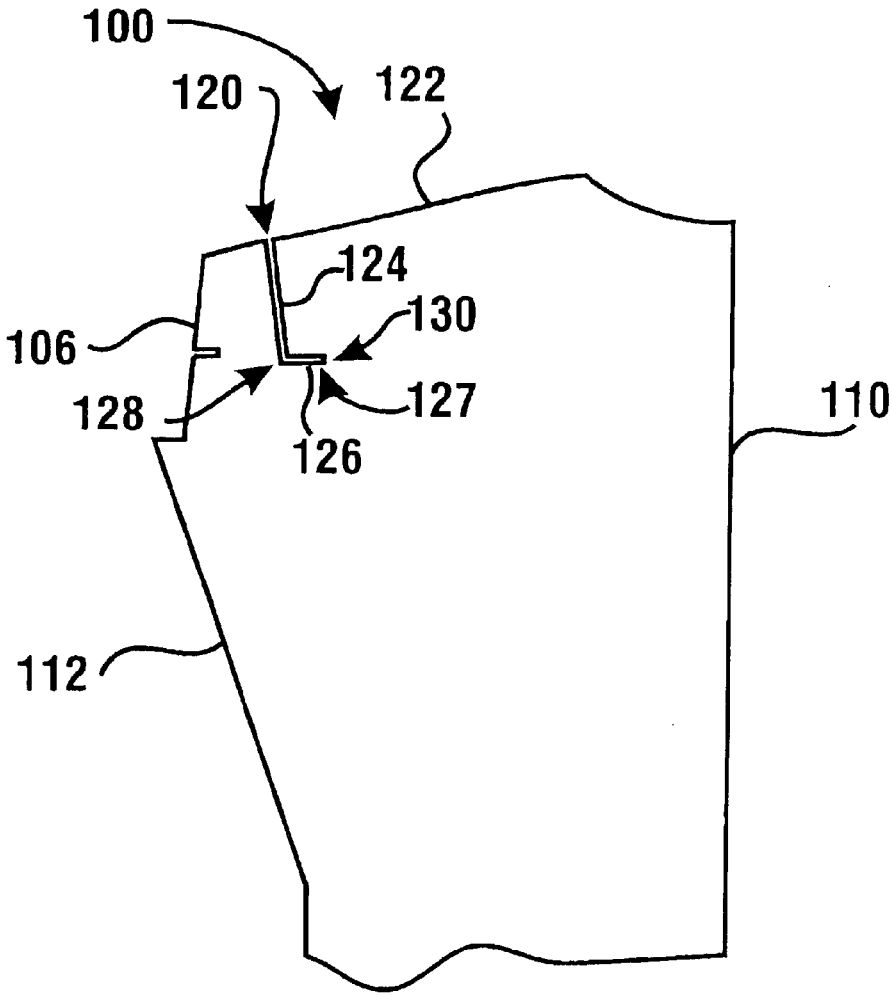
FIG. 5 shows a top plan view of an exemplary cut for a back panel with a slit.

As shown in FIG. 5, this described method for producing the exemplary pleat includes cutting a slit 120 in the back panel which extends downwardly from the shoulder seam edge 122. The slit 120 includes a generally vertical portion 124 that extends from the shoulder seam edge 122 of the back panel downwardly to a first end position 128. The slit 120 also includes a generally horizontal portion 126 that starts at the first end position 128 and extends away from the arm hole seam edge 106 to a second end position 130 that is closer to the center seam edge 110.

In this described exemplary embodiment, the position of the generally vertical portion 124 of the slit may correspond to the position where a standard arm hole seam edge cut would have been made on a standard sized back panel. However, it is to be understood that in other embodiments the generally vertical portion 124 of the slit may be located at other distances with respect to the arm hole seam edge 106 to form pleats with other sizes and widths.

Figure 6:
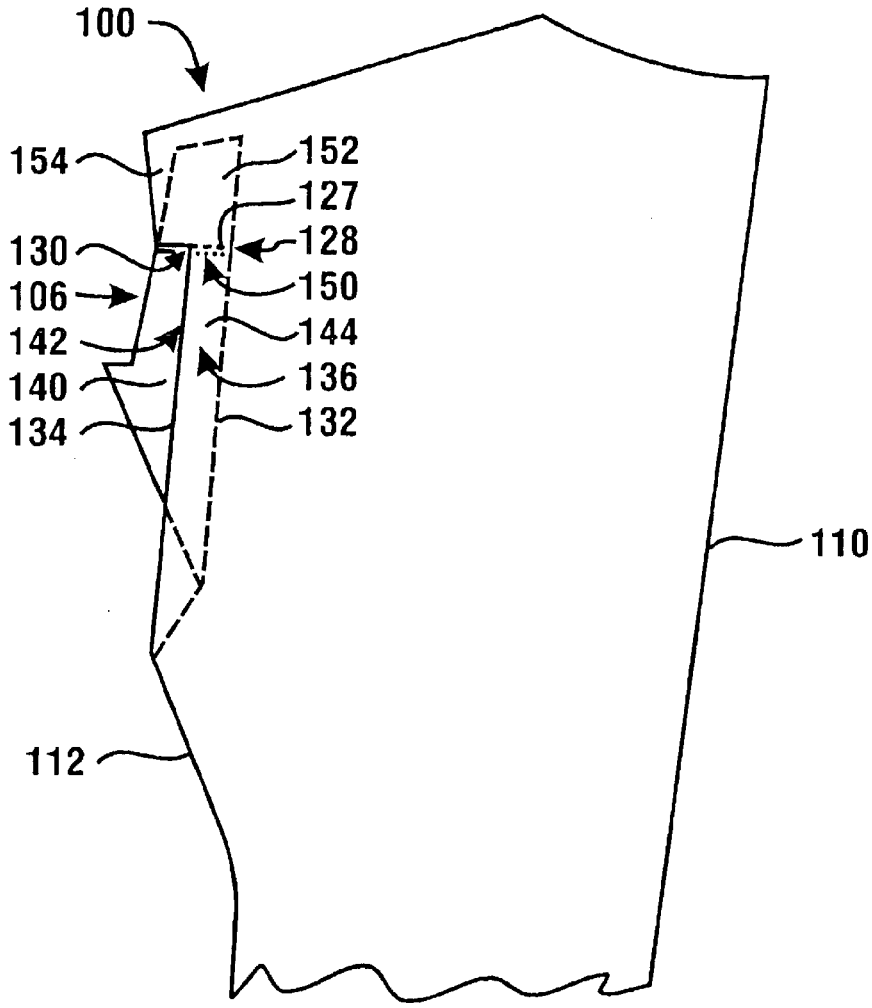
FIG. 6 shows a top plan view of an exemplary back panel after creating folds in the back panel.

As shown in FIG. 6 the exemplary method further includes creating an inner fold 132 and an outer fold 134 in the back panel 100 beneath the generally horizontal portion 126 of the slit 120. The locations of the folds are described with reference to the previously described first and second end positions 128 and 130 of the slit 120. However, because the folds 132, 134 cause the portions of the back panel above and below the generally horizontal portion 126 of the slit 120 to be displaced from each other, it is to be understood that the end positions 128 and 130 of the slit correspond to locations on the back panel adjacent the lower edge of the generally horizontal portion 126 of the slit 120.

In the exemplary embodiment, the inner fold 132 extends downwardly starting from about the first end position 128 located on the back panel adjacent the lower edge of the generally horizontal portion 126 of the slit 120. The outer fold 134 extends downwardly from about the second end position 130 located on the back panel adjacent the lower edge of the generally horizontal portion 126 of the slit 120. The inner fold 132 and outer fold 134 form an overlapped region 136 of the material in the back panel adjacent the arm hole seam edge 106. As previously described, the overlapped region 136 of the exemplary pleat being formed includes an inner layer of material 140, a middle layer of material 142, and an outer layer of material 144.

In the exemplary embodiment, the method further includes creating a first connection 150 between the inner layer 140 and the middle layer 142 of the overlapped region 136. The first connection 150 may be positioned beneath the bottom edge 127 of the generally horizontal portion of the slit. In this described exemplary embodiment, the first connection includes a generally horizontal stitching that is generally parallel to the bottom edge 127 of the generally horizontal portion of the slit. However, in other embodiments the first connection may include a temporary connector such as a pin.

Figure 7:
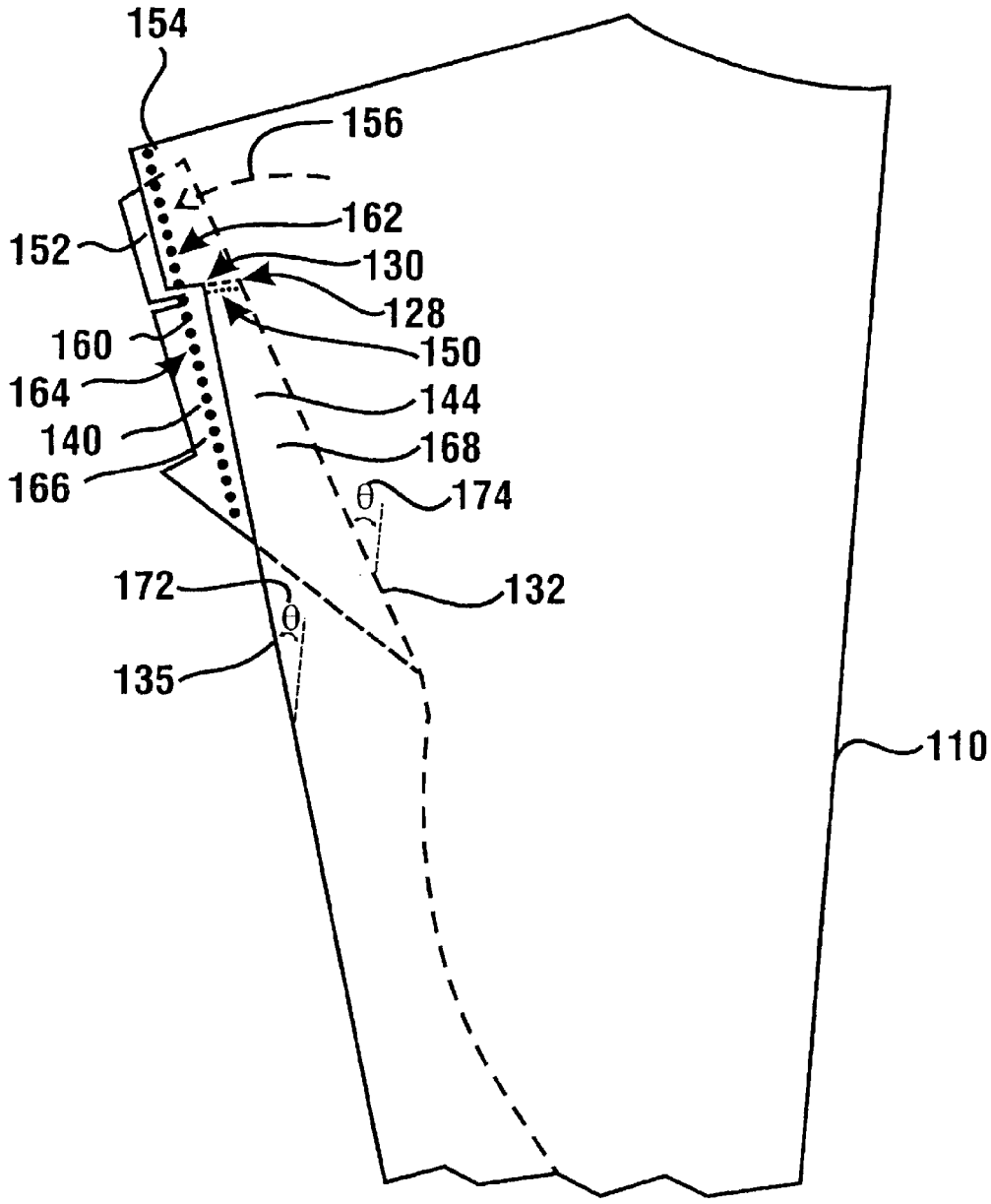
FIG. 7 shows a top plan view of an exemplary back panel showing the relative orientation of the folds after stitching the back panel to an arm sleeve.

As shown in FIG. 7, prior to stitching the back panel to an arm sleeve, the upper portion of the inner layer 152 located above the first connection 150 may be repositioned with respect to the upper portion of the outer layer 154 located above the first connection. In this described exemplary embodiment, the upper portion of the inner layer 152 is moved or pivoted in an angular direction 156 with respect to the location of the first connection 150 that is away from the center seam 110. To help guide the repositioning of the upper portion of the inner layer 152. The outer fold 134 may be re-folded in the back panel 100 to form a new outer fold 135 along a line that begins at the second end position 130 and tapers inwardly at a relatively larger angle towards the center seam edge 110. After creating the new outer fold 135, the position of the inner fold 132 extends along a line that begins at the first end position 128 and tapers inwardly at a relatively larger angle 174 towards the center seam edge 110.

As shown in FIG. 6, the original inner and outer folds 132, 134 were generally parallel to each other. After refolding the outer fold, the angle 174 of the inner fold 132 relative the center seam 110 is larger than the angle 172 of the new outer fold 135 relative the center seam 110. The refolding of the inner and outer folds is operative to quickly and precisely reposition the upper portion of the outer layer 152 relative the upper portion of the outer layer 154 prior to forming the lower and upper portions 162, 164 of the stitching 160.

In an alternative exemplary embodiment, the upper portion of the inner layer 152 may be bent in the outward angular direction 156 with respect to the upper portion of the outer layer 154 without refolding the outer fold 134. The bend of the inner layer 152 may occur at about the position of the first connection 150.

The exemplary embodiment of the described method further includes sewing the back panel to an arm sleeve. The sewing produces a stitching 160 between the back panel and the arm sleeve. To reduce the complexity of the back panel shown in FIG. 7, the stitching 160 is shown without the arm sleeve material. The stitching 160 shown in FIG. 7 corresponds to the stitching 68 in FIG. 3. FIG. 3 does show the stitching 68 at the seem 40 between the back panel 42 and the arm sleeve 44.

As shown in FIG. 7, an upper portion 162 of the stitching 160 is operative to bind both the upper portions of the inner layer 152 and the upper portions of the outer layer 154 of the back panel to the arm sleeve. A lower portion 164 of the stitching 160 is operative to bind the lower portion of the inner layer 166 located beneath the first connection 150 to the arm sleeve. The lower portion 164 of the stitching 160 does not include the lower portion of the outer layer 168 located beneath the first connection 150. As a result, a pleat is formed with an opening beneath the first connection 150.

In this described exemplary method, the back panel may be stitched to the arm sleeve while the layers in the overlapped region are under tension. This tension may be formed by bending or pivoting the upper portion of the inner layer outwardly after the first connection is created. This tension is operative to further assist the pleat in gathering excess material in the back panel so as to minimize the formation of wrinkles in the back panel. However, it is to be understood that in other exemplary embodiments the pleat may be formed in other orientations which form tension that is operative to pull or otherwise urge the edges of the sides of the back panel so as to smooth out or flatten the back panel. Also, in other exemplary embodiments, the pleat may be formed or stitched together without tension between the layers of the pleat. In such embodiments, the orientation or configuration of the pleat may be such that gravity acting on the pleat is operative to urge the back panel in a flattening manner that smooths out or otherwise reduces the size of wrinkles in the back panel of the jacket. In an exemplary embodiment of a jacket where the previously described pleats in the back panel are positioned adjacent both of the arm sleeves, the pleats are operative to urge the opposed sides of the back panel in opposite directions which urge the back panel in a flattening manner that smooths out or otherwise reduces the size of wrinkles in the back panel of the jacket. As used herein the terms flatten or flattening corresponds to causing the material of the back panel to lie or spread out smoothly and uniformly in a flat, generally flat and/or curved orientation adjacent the flat, generally flat and curved portions of a human torso's back.

An exemplary embodiment of the described jackets may be operative to fit well adjacent the backs of a plurality of differently sized torsos. In further exemplary embodiments, the previously described jacket or other garments with the exemplary pleats, may be labeled with a number range that corresponds to the range of standard suit sizes that the jacket may correspond thereto. For example, rather than labeling the suit jacket with a single number such as the number "40", the exemplary embodiment of the jacket may be labeled with a range of numbers such as "38–42".

Figure 8:
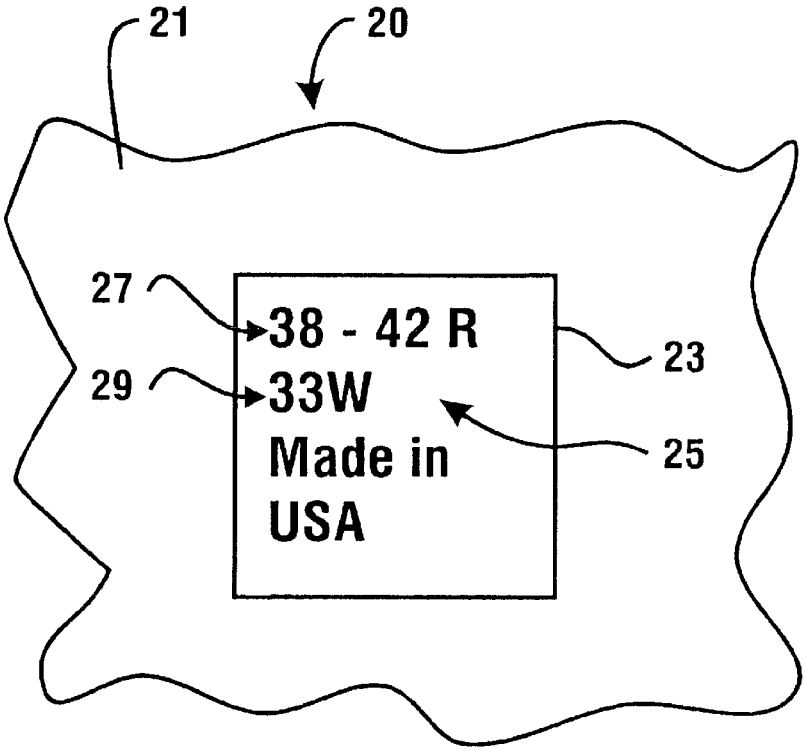
FIG. 8 shows an exemplary embodiment of a label attached to a garment that includes the exemplary embodiment of the pleats.

In addition, the exemplary embodiment of the jacket may include labeling which corresponds to the waist measurement for a person that the jacket was designed to properly fit. For example, the jacket may include a label such as "33W". In further exemplary embodiments, the exemplary jacket may include both a waist size measurement and a number range of standard jacket sizes such as "38–42R, 33W". Here, a letter after the size number range may correspond to the corresponding standard height size of the jacket such as "R" for regular or "S" for short". FIG. 8 shows an exemplary embodiment of a portion 21 of the jacket 20 first shown in FIG. 2. Here, the portion 21 of the jacket includes an example of a label 23 with the previously described indicia 25 which includes a range of standard jacket sizes 27 and a width size 29.

When selecting a jacket to purchase, a person may select the exemplary jacket based on a waist size label attached to the jacket which corresponds to the waist size of the person. In a retail environment such as a clothing store or department, the exemplary jackets or other upper body garments with the previously described pleats may be grouped by waist size. As a result, a person can quickly find a plurality of upper body garments that fit well both in the waist and in the back without having to have the upper body garment altered.

Thus, the new automated banking machine audible user interface system and method achieves one or more of the above stated objective, eliminates difficulties encountered in the use of prior devices and systems, solves problems and attains the desirable results described herein.

In the foregoing description, certain terms have been used for brevity, clarity and understanding, however no unnecessary limitations are to be implied therefrom, because such terms are used for descriptive purposes and are intended to be broadly construed. Moreover, the descriptions and illustrations herein are by way of examples and the invention is not limited to the exact details shown and described.

In the following claims, any feature described as a means for performing a function shall be construed as encompassing any means known to those skilled in the art to be capable of performing the recited function, and shall not be limited to the features and structures shown herein or mere equivalents thereof. The description of the exemplary embodiment included in the Abstract included herewith, shall not be deemed to limit the invention to features described therein.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

What is claimed is:

1. A garment comprising:

a back upper body portion that is adapted to cover at least a portion of a back upper body of a person, wherein the back upper body portion includes at least one pleat therein, wherein the at least one pleat includes an inner fold and an outer fold which forms an overlapped region with an inner layer of material, a middle layer of material, and an outer layer of material;

at least one sleeve portion in operative connection with the back upper body portion, wherein the at least one sleeve portion is adapted to receive an arm of the person therethrough, wherein the at least one pleat is positioned adjacent a seam between the back upper body portion and the at least one sleeve portion;

at least one first connection between the inner layer and the middle layer;

at least one second connection between the at least one sleeve portion, the inner layer, and the outer layer, wherein the at least one second connection is located above the at least one first connection; and at least one third connection between the at least one sleeve portion and the inner layer, wherein the at least one third connection is located beneath the at least one first connection.

2. The garment according to claim 1, wherein when the garment is worn by a person, the at least one pleat is operative to create a sufficient amount of tension in the back upper body portion to urge portions of the back upper body portion to lie in a flattening manner adjacent a back of the person.

3. The garment according to claim 1, wherein the at least one first connection, the at least one second connection, and the at least one third connection include at least one stitching, wherein the third connection does not directly stitch the outer layer and the at least one sleeve portion together, wherein the first connection does not directly stitch the outer layer and the middle layer together.

4. The garment according to claim 1, wherein the majority of the lengths of the inner and outer folds do not include pressed creases.

5. The garment according to claim 1, further comprising a stitching at the seam between the back upper body portion and the at least one sleeve portion, wherein at least a portion of the stitching is operative to hold the at least one pleat together, wherein the stitching includes the at least one second connection and the at least one third connection.

6. The garment according to claim 1, wherein the inner and outer folds are operative to form a pocket and an opening to the pocket, wherein the opening generally faces the at least one sleeve portion.

7. The garment according to claim 6, wherein the at least one first connection includes a generally horizontal stitching between the inner layer and the middle layer, wherein the generally horizontal stitching extends between the inner fold and the seam between the back upper body portion and the at least one sleeve portion, wherein an upper portion of the pocket is bounded by the generally horizontal stitching.

8. The garment according to claim 1, further comprising a stitching at the seam between the back upper body portion and the at least one sleeve portion, wherein the stitching includes a first portion and a second portion, wherein the first portion of the stitching includes the at least one second connection and is operative to bind both an upper end of the outer layer and an upper end of the inner layer together and to the at least one sleeve portion, wherein the second portion of the stitching includes the at least one third connection and is operative to bind a lower end of the inner layer to the at least one sleeve portion, wherein the second portion of the stitching does not directly stitch a lower end of the outer layer to the at least one sleeve portion.

9. The garment according to claim 8, wherein when the garment is being worn by the person, the outer fold is generally vertical aligned with the seam between the back upper body portion and the at least one sleeve portion.

10. The garment according to claim 1, wherein the back upper body portion includes a second pleat therein, further comprising a second sleeve portion in operative connection with the back upper body portion, wherein the second sleeve portion is adapted to receive a second arm of the person therethrough, wherein the second pleat is positioned adjacent a second seam between the back upper body portion and the sleeve portion, wherein both the first and second pleats are adapted to urge the back upper body portion between the first and second pleats in opposed directions, whereby the formation of wrinkles in the upper body portion between the first and second pleats is minimized.

11. The garment according to claim 1, wherein the back upper body portion includes a back panel of a suit jacket.

12. The garment according to claim 1, further comprising a label in operative connection with the garment, wherein the label includes indicia representative of a waist size.

13. The garment according to claim 1, further comprising a label in operative connection with the garment, wherein the label includes indicia representative of a range of standard suit sizes.

14. The garment according to claim 1, further comprising a label in operative connection with the garment, wherein the label includes indicia representative of both a range of standard suit sizes and indicia representative of a waist size.

15. The garment according to claim 1, wherein the garment corresponds to a jacket.

16. A garment comprising:

a back upper body portion that is adapted to cover at least a portion of a back upper body of a person, wherein the back upper body portion includes at least one pleat therein, wherein the at least one pleat includes an inner fold and an outer fold which forms an overlapped region with an inner layer of material, a middle layer of material, and an outer layer of material;

at least one sleeve portion in operative connection with the back upper body portion, wherein the at least one sleeve portion is adapted to receive an arm of the person therethrough, wherein the at least one pleat is positioned adjacent a seam between the back upper body portion and the at least one sleeve portion, whereby when the garment is being worn by the person, the at least one pleat is operative to minimize the formation of wrinkles in the back upper body portion;

a stitching at the seam between the back upper body portion and the at least one sleeve portion, wherein the stitching includes a first portion and a second portion, wherein the first portion of the stitching is operative to bind both an upper end of the outer layer and an upper end of the inner layer together and to the at least one sleeve portion, wherein the second portion of the stitching is operative to bind a lower end of the inner layer to the at least one sleeve portion, wherein the second portion of the stitching does not directly stitch a lower end of the outer layer to the at least one sleeve portion, wherein the stitching at the seam includes the inner layer bound to the at least one sleeve portion such that the upper end of the inner layer is bend towards the seam with respect to the lower end of the inner layer.

17. The garment according to claim 16, further comprising a stitching between the inner layer and the middle layer, wherein the inner layer is bent at about the location of the stitching between the inner layer and the middle layer.

18. The garment according to claim 17, wherein the stitching between the inner layer and the middle layer begins adjacent an end of the elbow seam of the sleeve and extends in a direction that is generally perpendicular to the stitching at the seam between the back upper body portion and the at least one sleeve portion.

19. The garment according to claim 17, wherein the first portion of the stitching is above the generally horizontal stitching and the second portion of the stitching is below the generally horizontal stitching.

20. A method comprising:

a) cutting a back panel for a garment from a material, wherein the back panel is cut to include a shoulder seam edge, an arm hole seam edge, and a slit, wherein the slit includes a generally vertical portion that extends from the shoulder seam edge of the back panel downwardly to a first end position, wherein the slit includes a generally horizontal portion that starts at the first end position and extends away from the arm hole seam edge to a second end position;

b) creating an inner fold and an outer fold in the back panel beneath the generally horizontal portion of the slit, wherein the inner fold extends downwardly starting from about the first end position located on the back panel adjacent a lower edge of the generally horizontal portion of the slit, wherein the outer fold extends downwardly from about the second end position located on the back panel adjacent the lower edge of the generally horizontal portion of the slit, wherein the inner fold and outer fold form an overlapped region of the material in the back panel adjacent the arm hole seam edge, wherein the overlapped region includes an inner layer of material, a middle layer of material, and an outer layer of material;

c) creating a first connection between the inner layer and the middle layer of the overlapped region, wherein the first connection is positioned beneath a lower edge of the generally horizontal portion of the slit; and d) sewing the back panel to an arm sleeve, wherein portions of the inner layer and the outer layer of the back panel located above the first connection are both stitched to the arm sleeve, and wherein portions of the inner layer located beneath the first connection are stitched to the arm sleeve.

21. The method according to claim 20, wherein prior to step (d) further comprising:

e) moving the inner layer located above the first connection relative the outer layer located above the first connection, wherein the inner layer is moved to a position that is farther away from a center seam edge of the back panel.

22. The method according to claim 20, wherein prior to step (d) further comprising:

e) bending the inner layer located above the first connection relative the inner layer located below the first connection, wherein the inner layer above the first connection is moved to a position that is farther from a center seam edge of the back panel.

23. The method according to claim 20, wherein in step (c) the first connection includes a generally horizontal stitch that is generally parallel with the lower edge of the generally horizontal portion of the slit.

24. The method according to claim 20, wherein in step (c) the first connection includes a pin.

25. The method according to claim 20, further comprising:

e) creating a generally horizontal stitch between the inner layer and the middle layer beneath the lower edge of the generally horizontal portion of the slit.

26. The method according to claim 20, wherein in step (a) the first end position is located adjacent the intended position of an end of an elbow sleeve seam of an arm sleeve.

27. A method comprising:

a) creating two folds adjacent an arm hole seam edge of a back panel of a garment to form an overlapped region with an inner layer of material, a middle layer of material, and an outer layer of material;

b) creating a first connection between the inner layer and the middle layer;

c) creating a second connection between an arm sleeve, the inner layer, and the outer layer, wherein the second connection is located above the first connection; and d) creating a third connection between the arm sleeve and the inner layer, wherein the third connection is located beneath the first connection.

28. The method according to claim 27, wherein in step (d) the third connection does not include stitching between the outer layer and the arm sleeve.

29. The method according to claim 27, wherein prior to step (c) further comprising:

e) moving the inner layer located above the first connection from a first position to a second position relative the outer layer located above the first connection, wherein the second position is farther from a center seam edge of the back panel than the first position.

30. The method according to claim 29, wherein step (e) includes refolding an outer fold of the two folds so that the outer fold tapers inwardly at a larger angle towards the center seam edge.

31. The method according to claim 27, wherein prior to step (c) further comprising:

e) bending the inner layer located above the first connection in a direction that is farther from a center seam edge of the back panel.

32. The method according to claim 31, wherein in step (e) the inner layer located above the first connection is bent at about the location of the first connection.

33. The method according to claim 27, wherein in steps (c) and (d) the second connection and third connection are portions of a continuous stitching.

* * * * *